US008752826B2

(12) United States Patent
Komuro et al.

(10) Patent No.: US 8,752,826 B2
(45) Date of Patent: Jun. 17, 2014

(54) RECORDING APPARATUS

(75) Inventors: Shintaro Komuro, Nagano-ken (JP); Satoshi Kawamura, Nagano-ken (JP); Shoma Kudo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 139 days.

(21) Appl. No.: 13/409,571

(22) Filed: Mar. 1, 2012

(65) Prior Publication Data

US 2012/0223475 A1 Sep. 6, 2012

(30) Foreign Application Priority Data

Mar. 2, 2011 (JP) ..... 2011-045431
Mar. 2, 2011 (JP) ..... 2011-045432

(51) Int. Cl.
*B65H 31/10* (2006.01)

(52) U.S. Cl.
USPC ..... 271/217; 271/215; 271/214

(58) Field of Classification Search
USPC ..... 271/213, 214, 215, 217, 219
See application file for complete search history.

(56) References Cited

U.S. PATENT DOCUMENTS 6,234,076 B1 * 5/2001 Mizutani et al. ..... 101/118
2013/0156484 A1 * 6/2013 Mandel et al. ..... 400/621

FOREIGN PATENT DOCUMENTS

JP 2010-235311 10/2010

* cited by examiner

*Primary Examiner* — Michael McCullough
*Assistant Examiner* — Howard Sanders

(57) ABSTRACT

A recording apparatus includes a supply holding section that holds paper, which is supplied to a printing section, in an overlapping manner; a paper discharging roller that discharges the paper from the printing section; a discharge holding section that holds the paper, which are discharged from the paper discharging roller, in an overlapping manner, and is installed movably to the supply holding section, in an overlapping manner; and a moving unit that is moved to move the discharge holding section to the supply holding section so as to widen a difference of a height between the discharge holding section and the paper discharging roller according to a decrease of a holding amount of the paper in the supply holding section.

11 Claims, 11 Drawing Sheets

RECORDING APPARATUS

BACKGROUND

1. Technical Field

The present invention relates to a recording apparatus including a media holding device that holds recording media, which are discharged by performing a predefined process in a media processing section, in an overlapping manner.

2. Related Art

In the related art, a media holding device is known (see, JP-A-2010-235311), which includes a supply holding section (a main tray) that is installed at a recording apparatus and can accommodate recording media (recording papers), which is supplied to the media holding device, in an overlapping manner, and a discharge holding section (a paper discharging tray) that is arranged so as to overlap at an upper side of the supply holding section, and holds the recording media, which have been recorded, in an overlapping manner.

The media holding device is configured such that the recording media with which a predetermined process is performed in the media processing section and which are discharged are held at a discharge holding section fixed in a lamination direction, in an overlapping manner.

However, the media holding device of the related art needs to ensure beforehand a space, on the discharge holding section, according to the maximum number of the recording media that can be held regardless of the quantity of the recording media to be processed. Thus, it is difficult to downsize the recording apparatus or the like in which the media holding device is installed.

SUMMARY

An advantage of some aspects of the invention is that it provides a media holding device and a recording apparatus including the media holding device, in which a holing capacity can be changed according to the number of the recording media that have been processed.

According to an aspect of the invention, a recording apparatus includes a supply holding section that holds recording media, which are supplied to a recording section, in an overlapping manner; a discharging roller that discharges the recording media from the recording section; a discharge holding section that holds recording media, which are discharged from the discharging roller, in an overlapping manner, and is installed movably to the supply holding section, in an overlapping manner; and a moving unit that is moved to move the discharge holding section to the supply holding section so as to widen a difference of a height between the discharge holding section and the discharging roller according to a decrease of a holding amount of the recording media in the supply holding section.

According to the aspect of the invention, the discharge holding section moves to the direction where the holding capacity (the amount which can be held) increases in response to the decrease of the holding amount of the recording media in the supply holding section. As described above, since the holding capacity can be varied in response to the quantity (the holding amount) of the recording media that have been processed, a space does not need to ensure beforehand on the discharge holding section according to the maximum capacity. Accordingly, the recording apparatus can be downsized.

It is preferable that the discharge holding section has a contact member that can make contact with the recording media held in the supply holding section.

According to the aspect of the invention, even though the configuration is that the discharge holding section moves to the supply holding section in response to the decrease of the holding amount of the recording media in the supply holding section so as to widen the difference of height between the discharge holding section and the discharging roller, the outermost sheet of the recording media makes contact with the contact member, in which the recording media are held in the supply holding section, in an overlapping manner. Accordingly, the outermost sheet of the recording media supplied to the media processing section are not damaged.

It is preferable that the recording apparatus further includes a shaft that is formed at a side surface of the discharge holding section, a guide that is formed at a frame opposite to the side surface of the discharge holding section and through which the shaft can move, and wherein the discharge holding section is configured so that the discharge holding section can move toward the supply holding section while maintaining a posture thereof.

According to the aspect of the invention, the holding capacity can be varied in response to the quantity (the holding amount) of the recording media that have been processed.

It is preferable that the discharge holding section has a fixing holding section that holds a downstream side of the recording media in the discharging direction and a movable holding section which is rotatably provided to the fixing holding section, to hold an upstream side of the recording media in the discharging direction, wherein the movable holding section is movably arranged toward the supply holding section in an overlapping manner, wherein the moving unit includes a rotation unit that is rotated to move the movable holding section to the supply holding section so as to increase the height of the discharge holding section and the discharging roller in response to a decrease of the holding amount of the recording media in the supply holding section.

According to the aspect of the invention, the holding capacity can be varied in response to the quantity (the holding amount) of the recording media that have been processed.

It is preferable that the moving unit has a biasing unit that biases the discharge holding section to the supply holding section.

According to the aspect of the invention, the biasing unit (a spring or the like) reliably moves to the direction where the holding capacity increases along the moving shaft. Type of spring is not limited and a compression spring may be used or a torsion spring may be used.

It is preferable that the discharge holding section is installed in a recumbent posture and the moving unit is moved by its own weight.

According to the aspect of the invention, when the recording media laminated in the supply holding section are supplied to the recording section, the discharge holding section descends by its own weight according to the laminated amount that is decreased in the supply holding section. Thus, the mechanism that moves the discharge holding section can be omitted and the configuration of the recording apparatus can be simplified. Accordingly, it is possible to save the space and lower the cost.

It is preferable that the contact member is a free roller.

According to the aspect of the invention, even though the configuration is that the discharge holding section moves to the supply holding section in response to the decrease of the holding amount of the recording media in the supply holding section so as to widen the difference of height between the discharge holding section and the discharging roller, the outermost sheet of the recording media makes contact with the free roller with rolling manner, in which the recording media are held in the supply holding section in an overlapping manner. Accordingly, the outermost sheet of the recording media supplied to the recording section are not subject to damage. In addition, the recording media held in the supply holding section are prevented from scattering and smooth transportation of the recording media to the media processing section is not affected.

It is preferable that a cam is formed at one of the supply holding section and the discharge holding section, and a cam follower abutting the cam is formed at the other, and when setting the supply holding section in a state of being used, the cam abuts the cam follower and pushes up the free roller.

According to the aspect of the invention, it is possible to prevent contamination due to contact between the recording media and the free roller when the supply holding section is inserted or removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
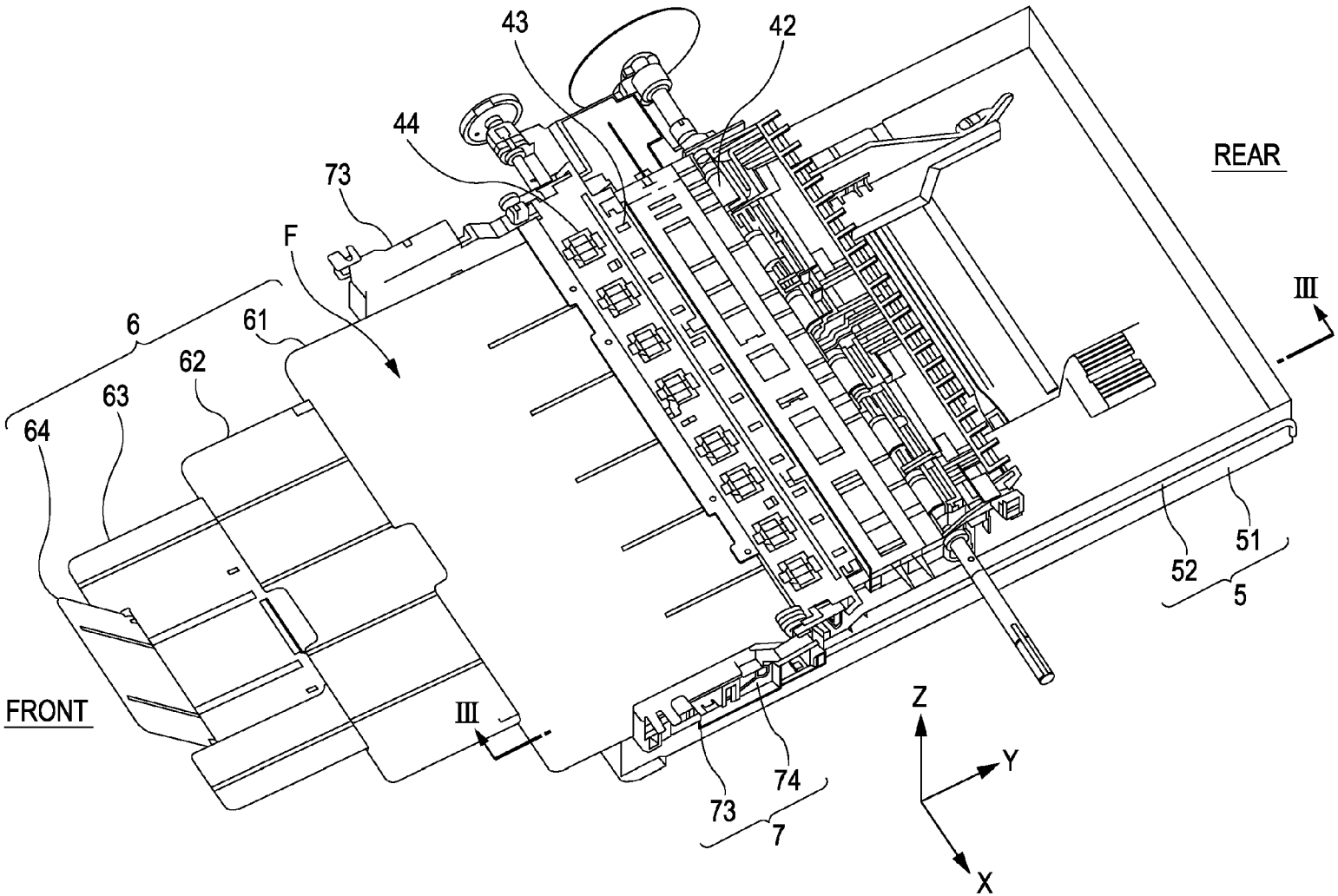
FIG. 1 is a perspective view of a recording media cassette, a discharge holding section and a moving unit according to a first embodiment of the invention.

Hereinafter, a recording apparatus according to a first embodiment of the invention will be described with reference to attached drawings. The recording apparatus is a so-called horizontal type apparatus which performs a desired recording while transporting papers (recording media) held in a recumbent posture, and holds (stacks) the recorded paper in the recumbent posture, which is discharged. In addition, as shown in each view, an X-axis (the left and right) direction, a Y-axis (the front and back) direction and a Z-axis (the up and down) direction are defined, and described below.

As shown in FIGS. 1 to 3B, the recording apparatus 1 includes an ink jet type printing section 3 that performs a printing process on a paper P facing a transport path, a transportation section 4 that transports the paper P sheet along the transport path, a recording media cassette 5 that accommodates the paper P in the recumbent posture and is detachably installed to a case 2, a discharge holding section 6 that holds (stacks) the discharged paper P on which the printing (the recording) is performed, a moving unit 7 that moves the discharge holding section 6 so as to enter into the recording media cassette 5, and an apparatus frame (not shown) that supports the transportation section 4, the printing section 3, or the like. A media holding device is configured including the recording media cassette 5, the discharge holding section 6 and the moving unit 7.

Figure 2:
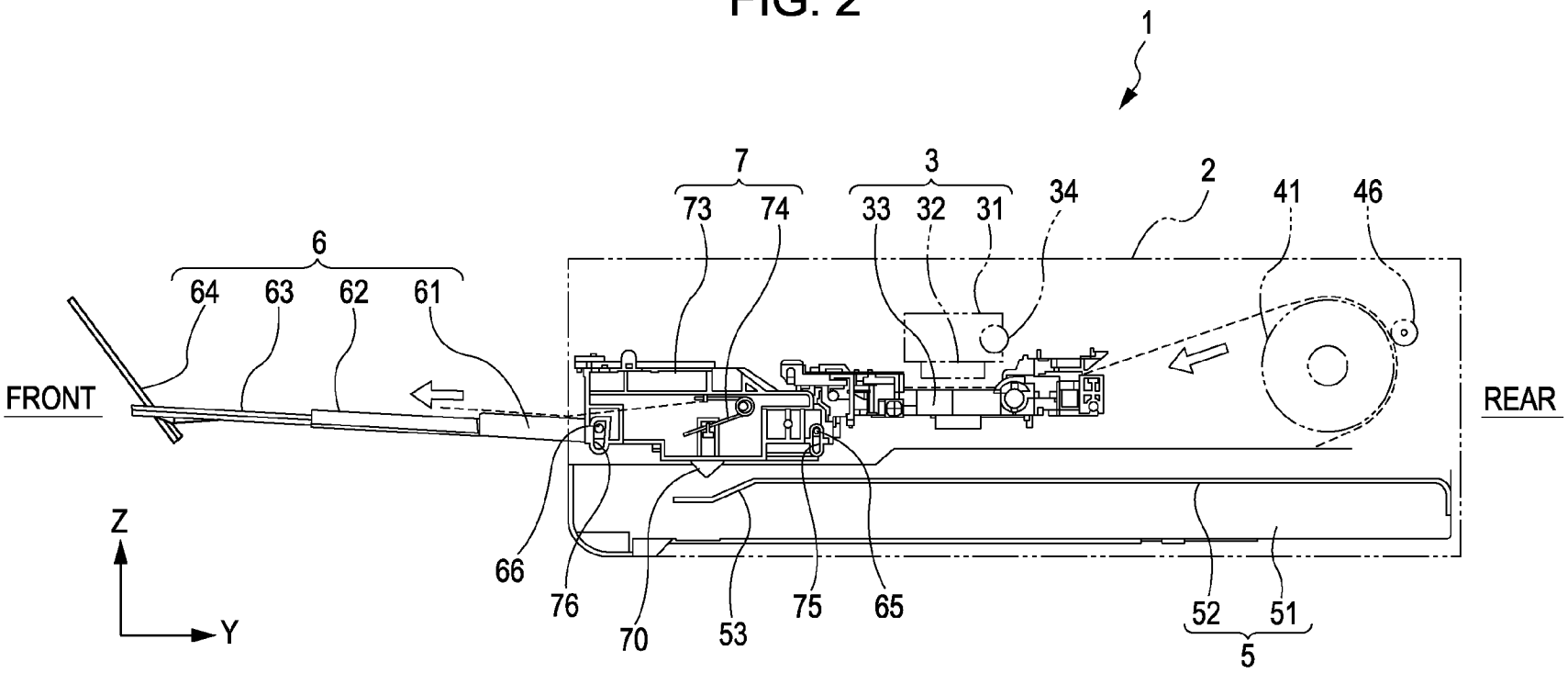
FIG. 2 is a side view of a recording media cassette, a discharge holding section and a moving unit according to a first embodiment of the invention.

As shown in FIG. 2, the printing section 3 has a carriage 31 that is arranged at a downstream side of a pair of transportation rollers 42 (described below) and equipped with an ink jet head 32, and a guide member 33 provided at a position opposite to the ink jet head 32.

The carriage 31 is provided movably reciprocated by a motor (not shown) along the carriage guide shaft 34 extending in the X-axis direction. The recording apparatus 1 of the embodiment is a so-called off-carriage type serial printer, in which the ink cartridge (not shown) is provided independently of the carriage 31, and the carriage 31 performs the recording while moving in the X-axis direction. In addition, the guide member 33 configures of a portion of the transport path and defines a gap (a work gap) between a recording surface of the paper P and the ink jet head 32.

In addition, the embodiment uses an off-carriage type serial printer, however, it may be a so-called on-carriage type in which the ink carriage is equipped in the carriage 31, or may use a fixed type ink jet head 32 that covers the width of the paper P. Furthermore, it is not limited to the ink jet type and may be another recording type of recording device.

Figure 3A:
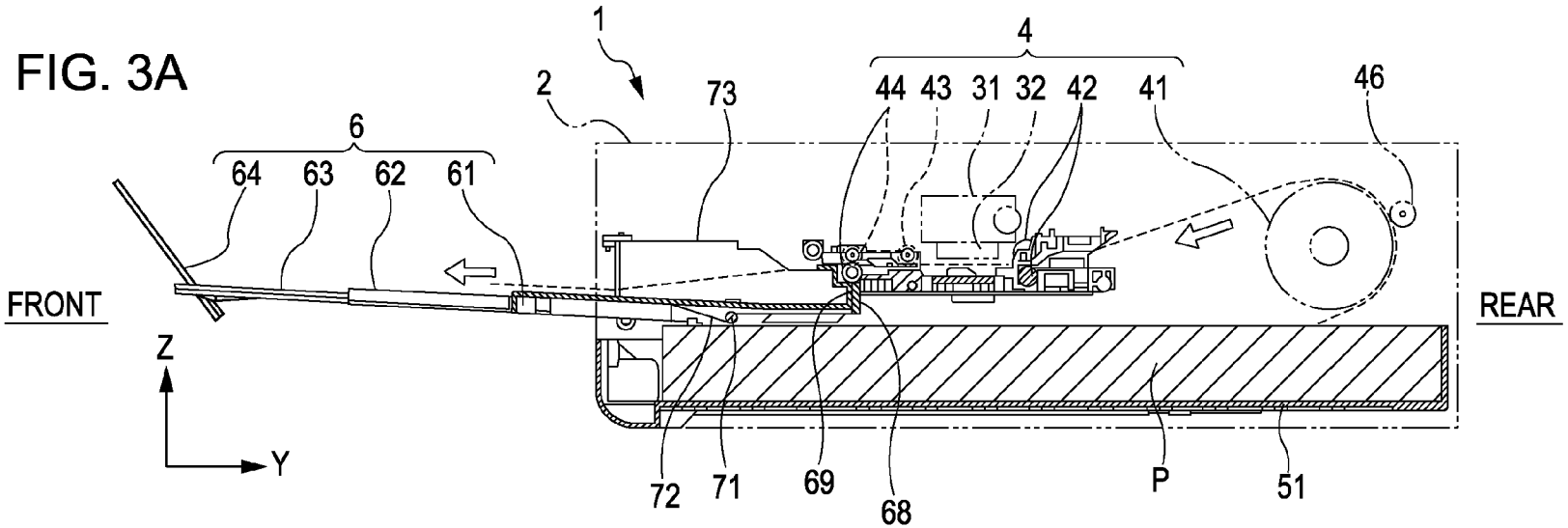
FIG. 3A is a cross-sectional view of a recording media cassette and a discharge holding section taken along line IIIA-IIIA of FIG. 1.
Figure 3B:
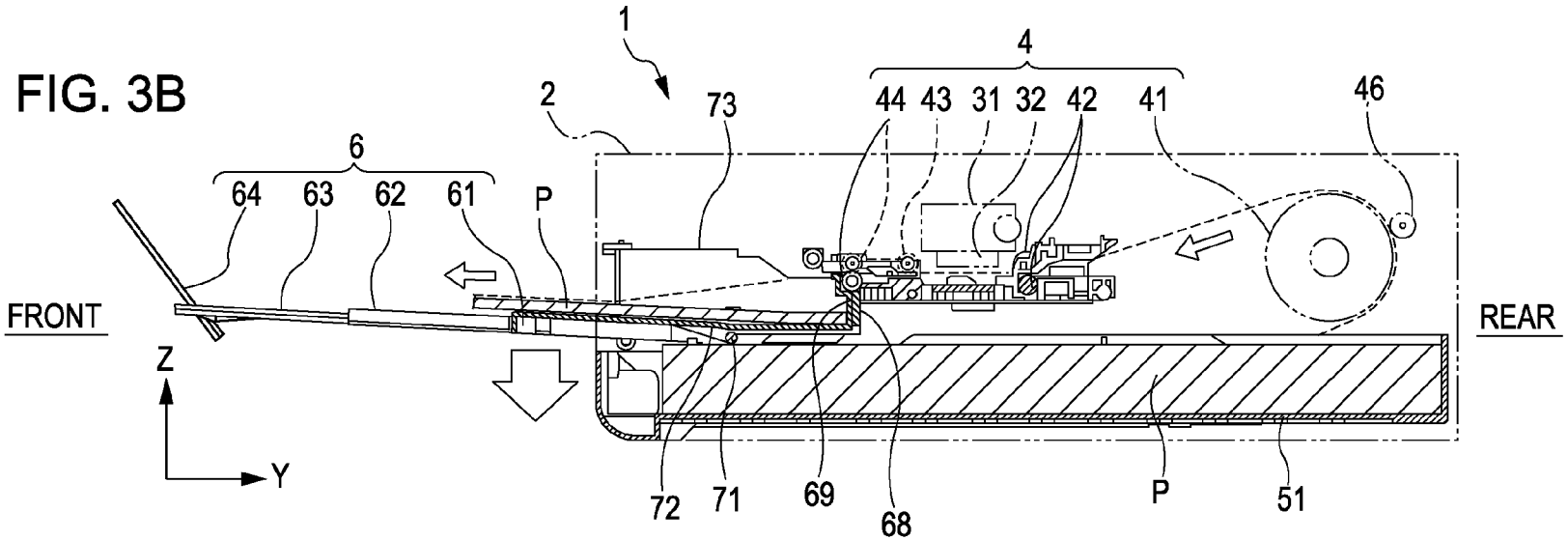
FIG. 3B is a cross-sectional view of a recording media cassette and a discharge holding section taken along line IIIB-IIIB of FIG. 1.

As shown in FIGS. 3A and 3B, the transportation section 4 has a feeding roller 41 that is provided at a position opposite to a end of the recording media cassette 5 installed from an upstream side and sends the paper P to a downstream side, which is supplied from the recording media cassette 5 a pair of transportation rollers 42 that transports the paper P to the printing section 3, a guide roller 43 that prevents the paper P from lifting at the guide member 33 of the printing section 3, and paper discharging rollers 44 as a pair of discharging rollers that discharges the recorded paper P from the printing section 3.

The top paper P of laminated and accommodated papers in the recording media cassette 5 is picked up by a pick-up roller (not shown). Thus, the feeding roller 41 is rotated by a motor (not shown) in a state where the feeding roller 41 makes contact with the end of the picked up paper P so that the paper P sends in a rear direction in FIGS. 3A and 3B. In a position opposite to an outer peripheral surface of the feeding roller 41, a guide member (not shown) that forms a substantially U-shaped transport path where the paper P is curved and inverted, and an auxiliary driven roller 46 that helps send of the paper P with the feeding roller 41 are installed.

the paper P sent in the rear direction is positively inverted by the feeding roller 41 and the guide member, and is sent to a pair of transportation rollers 42 (see broken lines in FIGS. 2 to 3B). The paper P is pinched between a pair of transportation rollers 42 and transported to the printing section 3. The paper P where the recording is performed at the printing section 3 is discharged to the discharge holding section 6 via guide roller 43 and a pair of paper discharging rollers 44.

In addition, in the embodiment, the feeding roller (and the auxiliary driven roller 46), the transportation roller 42 and the paper discharging roller 44 take a nip-roller shape respectively and are arranged in plurality with appropriate intervals in the width direction (the X-axis direction) of the paper P. In the embodiment, the transportation roller 42 and the paper discharging roller 44 positioned at the guide member 33 side are driven to rotate by the motor (not shown) respectively, and the transportation roller 42, the guide roller 43 and the paper discharging roller 44 positioned at the ink jet head side are to be driven respectively. In addition, the paper discharging roller 44 of the driving side is configured of a rubber roller, and the guide roller 43 and the paper discharging roller 44 are configured of spur-shaped rollers (star wheels).

As shown in FIGS. 2 to 3B, the recording media cassette 5 is installed inside the case 2 with the recumbent posture and is slid to the case 2 in the horizontal direction so that the recording media cassette 5 is allowed to be attached/detached (inserted/removed). The recording media cassette 5 has a supply holding section 51 that stacks and holds the paper P supplying to the printing section 3, and a pair of left and right cams 52 that abuts a cam follower 70 (described below) of the discharge holding section 6.

The supply holding section 51 is formed in a tray-shape as the upper surface is opened and the paper P are set in a state where a plurality of papers P is laminated.

Each cam 52 is projected to the outside throughout from the rear end to near the front end in the both-side surfaces of the supply holding section 51. Each cam 52 abuts each cam follower 70 provided at the discharge holding section 6, and becomes a guide when the recording media cassette 5 is inserted to or removed from the case 2. In addition, each cam follower 70 abuts each cam 52, and then the discharge holding section 6 is pushed up so that each free roller 71 (described below) provided attachment rear surface is not making contact with the top paper P set in the supply holding section 51. Accordingly, it is possible to prevent contamination due to contact between the paper P and each free roller 71 when the recording media cassette 5 is inserted to or removed from the case 2.

In addition, an inclined section 53 is formed downward at a front portion of the cam 52 so that the cam follower 70 does not contacted with the inclined section 53 when the recording media cassette 5 is set to the case 2 (see, FIG. 2). In other words, a step is provided at the cam 52. In addition, the inclined section 53 is provided at a position where the cam follower 70 does not contacted with the inclined section 53 in a state where the discharge holding section 6 moves to the lower limit position.

As shown in FIGS. 2 to 3B, the discharge holding section 6 is installed on the recording media cassette 5 in the recumbent posture, and stacks and holds the paper P discharged from the printing section 3. The discharge holding section 6 has a discharge main-body section 61 that freely goes up and down, and engages with the moving unit 7, a second discharging section 62 that is freely slid in the front and rear (the Y-axis) direction and is provided to the discharge main-body section 61, a third discharging section 63 that freely slides in the front and rear direction and is provided to the second discharging section 62, and a fourth discharging section 64 that freely rotates and is provided to the downstream end of the third discharging section 63. In addition, the second discharging section 62 and the third discharging section 63 are appropriately drawn out according to the size of the paper P so that a holding surface that holds the discharged paper P is formed. In addition, the fourth discharging section 64 is also to be appropriately rotated so that the holding surface of the paper P is formed.

As shown in FIGS. 4A to 5B, the discharge main-body section 61 has a main-body holding surface F holding the discharged paper P, a first boss section 65 as a pair of shafts projected to the left and right both-side surfaces in the rear end, a second boss section 66 as a pair of shafts projected to the left and right both-side surfaces to the front a little more than center in the front and rear direction, a pair of left and right spring engaging sections 67 that is provided at substantially center between the first boss section 65 and the second boss section 66 in the front and rear direction, and a support piece 68 that supports the upstream end of the paper P that is held. In addition, the discharge main-body section 61 has a pair of left and right cam followers 70 that is projected to the lower side from the left and right both-side surfaces in the lower direction of each spring engaging section 67, and a pair of left and right free rollers 71 that is installed inside each cam follower 70 in the rear surface.

The discharge main-body section 61 is arranged with stacked to be possible from entering from the upper direction in the front direction of the supply holding section 51 in a state where the recording media cassette 5 is set to the case 2. The discharge main-body section 61 is supported and freely lifted by the moving unit 7 via a pair of left and right first boss section 65 and the second boss section 66.

Each spring engaging section 67 is formed in an upward hook-shape and a wire end of a torsion spring 74 (described below) is engaged. Each spring engaging section 67 penetrates in a moving frame 73 (described below) and then exposed to the outside.

The support piece 68 is projected substantially perpendicularly from the main-body holding surface F to upward in the rear end of the main-body holding surface F. In addition, the support piece 68 is positioned at the rear side of the fixing supporting section 69 projected from the apparatus frame to the lower side, and overlaps (engages) to the fixing supporting section 69 in the Z-axis direction (see FIGS. 3A and 3B). In addition, the support piece 68 is formed so as to slightly overlap to the fixing supporting section 69 in a state where the discharge holding section 6 (the discharge main-body section 61) is moved to the lower limit position (the maximum holding state) (see, FIG. 3B). Accordingly, in a state where the discharge main-body section 61 moves to the upper limit position, an overlap amount (a distance) is substantially the same as a moving amount (a distance) of the discharge holding section 6 (the discharge main-body section 61).

Each cam follower 70 is integrally formed to each side surface of the discharge main-body section 61 such that one vertex of the triangle is directed to the lower side. Thus, one vertex of the triangle abuts the above described cam 52.

Each free roller 71 is freely rotatably pivoted to a pair of roller arms 72 extending obliquely backward in the rear surface of the discharge main-body section 61. Each free roller 71 enters into the supply holding section 51 from the upper side and contacts with the top paper P of the bundle of papers P that are set at the supply holding section 51 (see, FIGS. 3A and 3B).

The free roller 71 is a contact member that can contact with the paper P held in the supply holding section 51. When the top paper P is sent by the driving of the transportation section 4, each free roller 71 is driven to rotate according to the transportation of the paper P. Accordingly, the supply and the sending of the paper P can be smoothly performed without damaging the top (the outermost sheet) paper P.

Figure 4A:
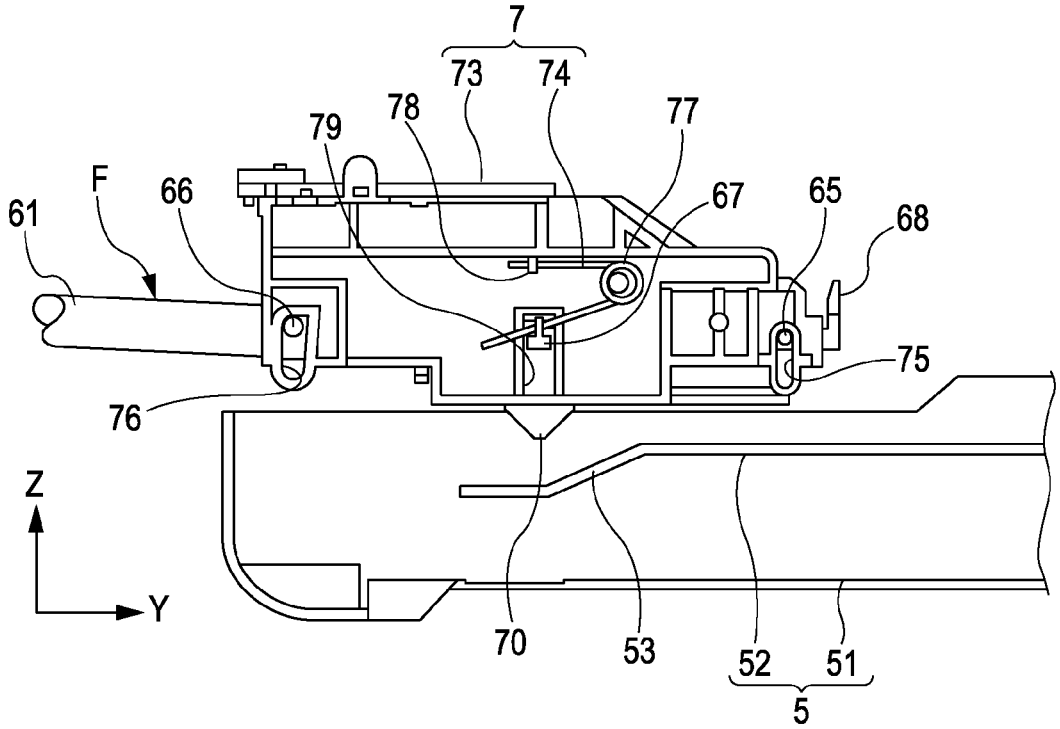
FIGS. 4A and 4B are partially enlarged side views illustrating a recording media cassette, a discharge holding section and a moving unit according to a first embodiment of the invention.
Figure 4B:
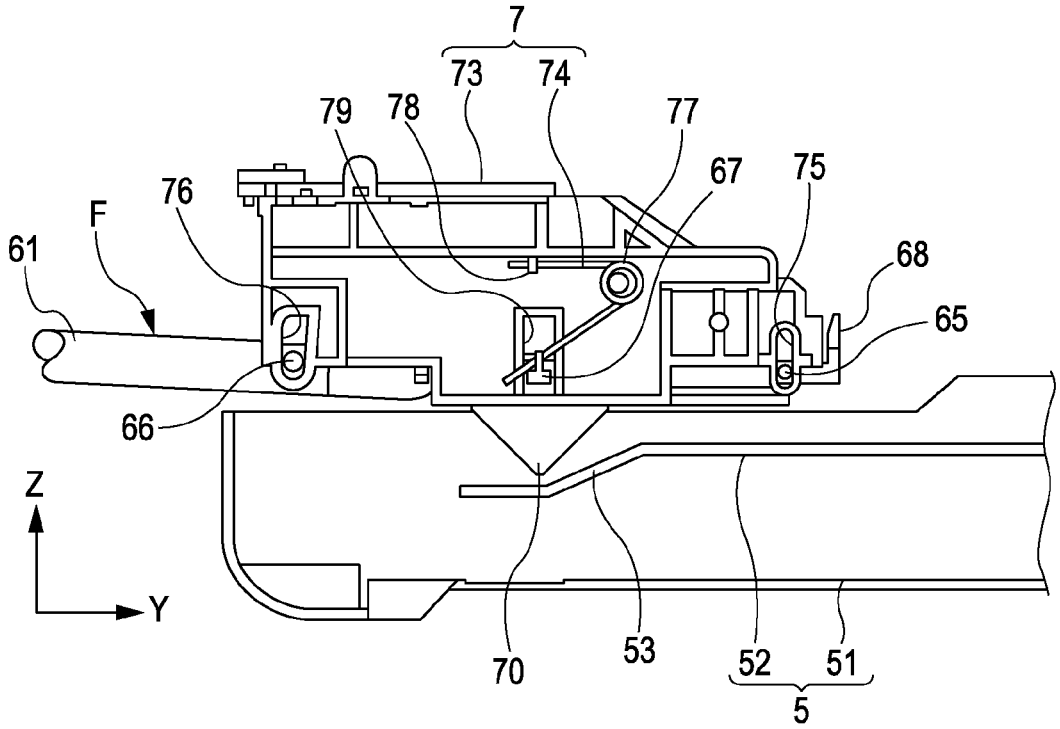
Figure 5A:
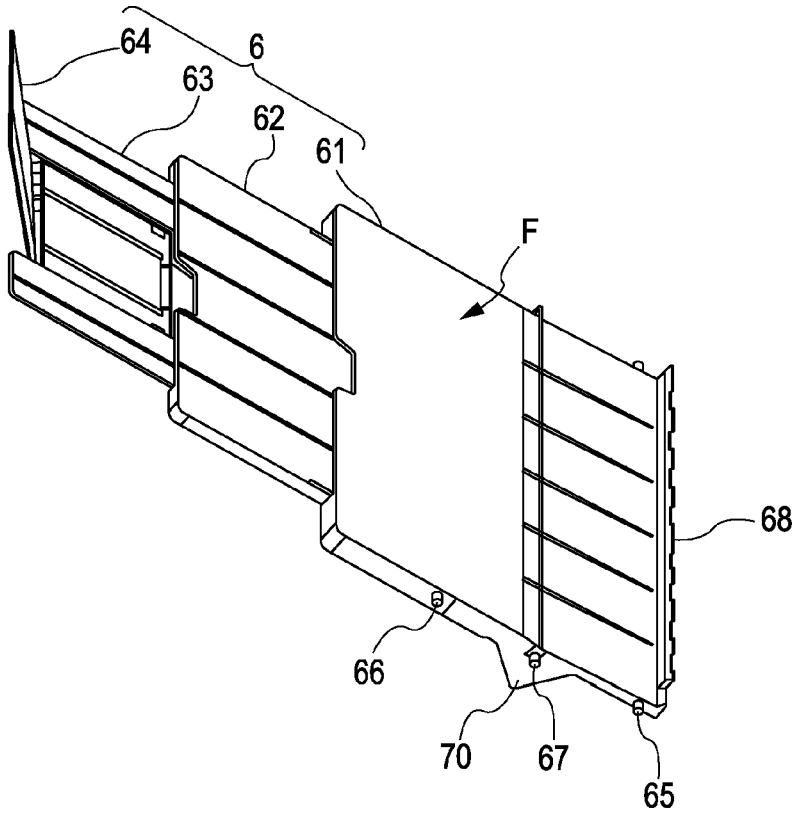
FIG. 5A is a front perspective view of a discharge holding section according to a first embodiment of the invention.
Figure 5B:
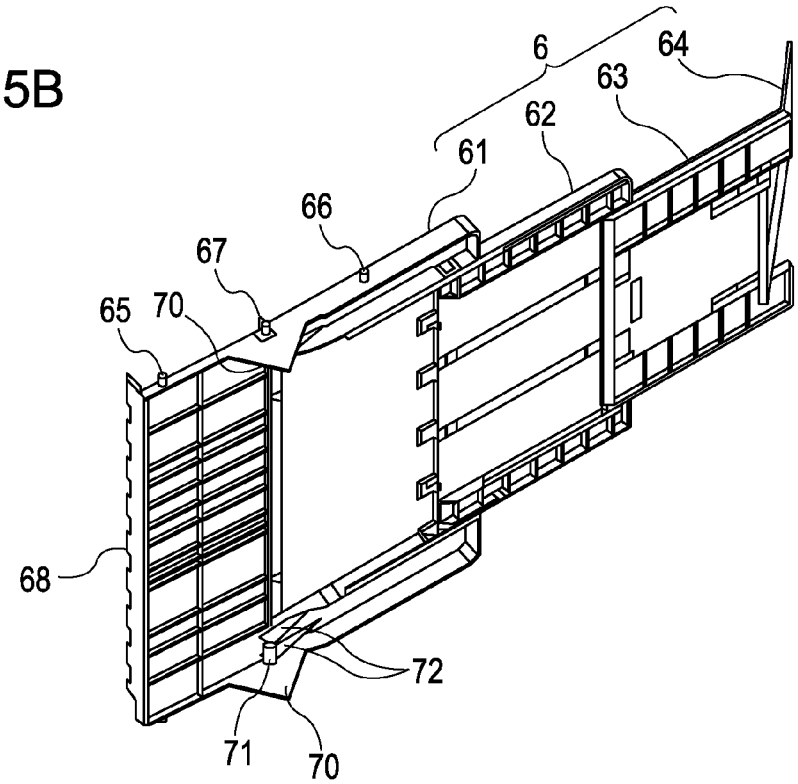
FIG. 5B is a rear perspective view of a discharge holding section according to a first embodiment of the invention.

As shown in FIGS. 2, 4A and 4B, the moving unit 7 has a pair of left and right moving frames 73 that is supported to the apparatus frame in the downstream side of the paper discharging rollers 44, and a pair of left and right torsion springs 74 that biases the discharge holding section 6 to the supply holding section 51.

Each moving frame 73 has a first engaging hole 75 where the first boss section 65 engages, a second engaging hole 76 where the second boss section 66 engages, a fixing boss section 77 where the torsion spring 74 is fitted and fixed, and a fixing hook section 78 where a wire end of the other side of the torsion spring 74 is engaged and fixed.

Each first engaging hole 75 is a long hole that penetrates in the X-axis direction in the rear end of the moving frame 73 and then is formed long in the Z-axis (the up and down) direction. Similarly, each second engaging hole 76 is a long hole that is long in the Z-axis (the up and down) direction in the front end of the moving frame 73 and penetrates and is formed in the X-axis direction. Each first boss section 65 movably engages with each first engaging hole 75 in the up and down direction, and each second boss section 66 movably engages with each second engaging hole 76 in the up and down direction. Accordingly, a pair of left and right first boss sections 65 and the second boss section 66 are guided by a pair of left and right first engaging hole 75 and the second engaging hole 76 as the guide so that the discharge holding section 6 (the discharge main-body section 61) moves up and down.

In addition, a length of each first engaging hole 75 and each second engaging hole 76 in the Z-axis direction are a moving distance of the discharge holding section 6, and is substantially the same as an overlap amount (a distance) in a state where the discharge main-body section 61 moves to the upper limit position. Accordingly, the upper limit position of the discharge main-body section 61 is a position where each of the boss sections 65 and 66 moves to the upper end of each of the engaging holes 75 and 76 (see FIGS. 3A and 4A), while the lower limit position of the discharge main-body section 61 is a position where each of the boss sections 65 and 66 moves to the lower end of each of the engaging holes 75 and 76 (see FIGS. 3B and 4B).

Figure 6:
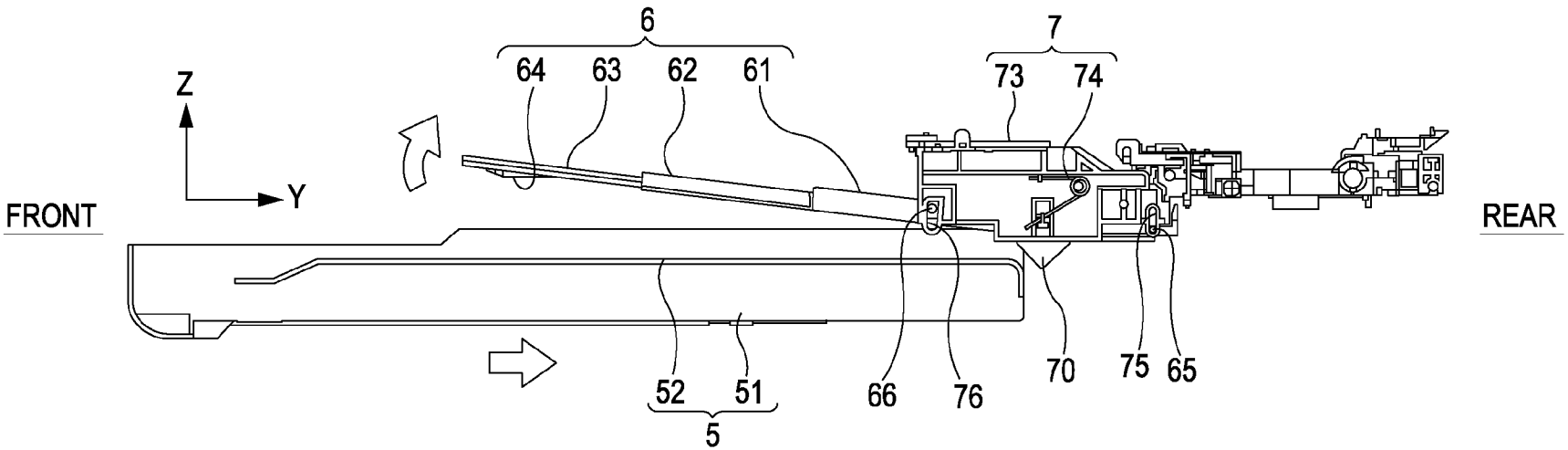
FIG. 6 is a side view illustrating how the front of a discharge holding section is lifted, when a recording media cassette is inserted into a case.
Figure 7:
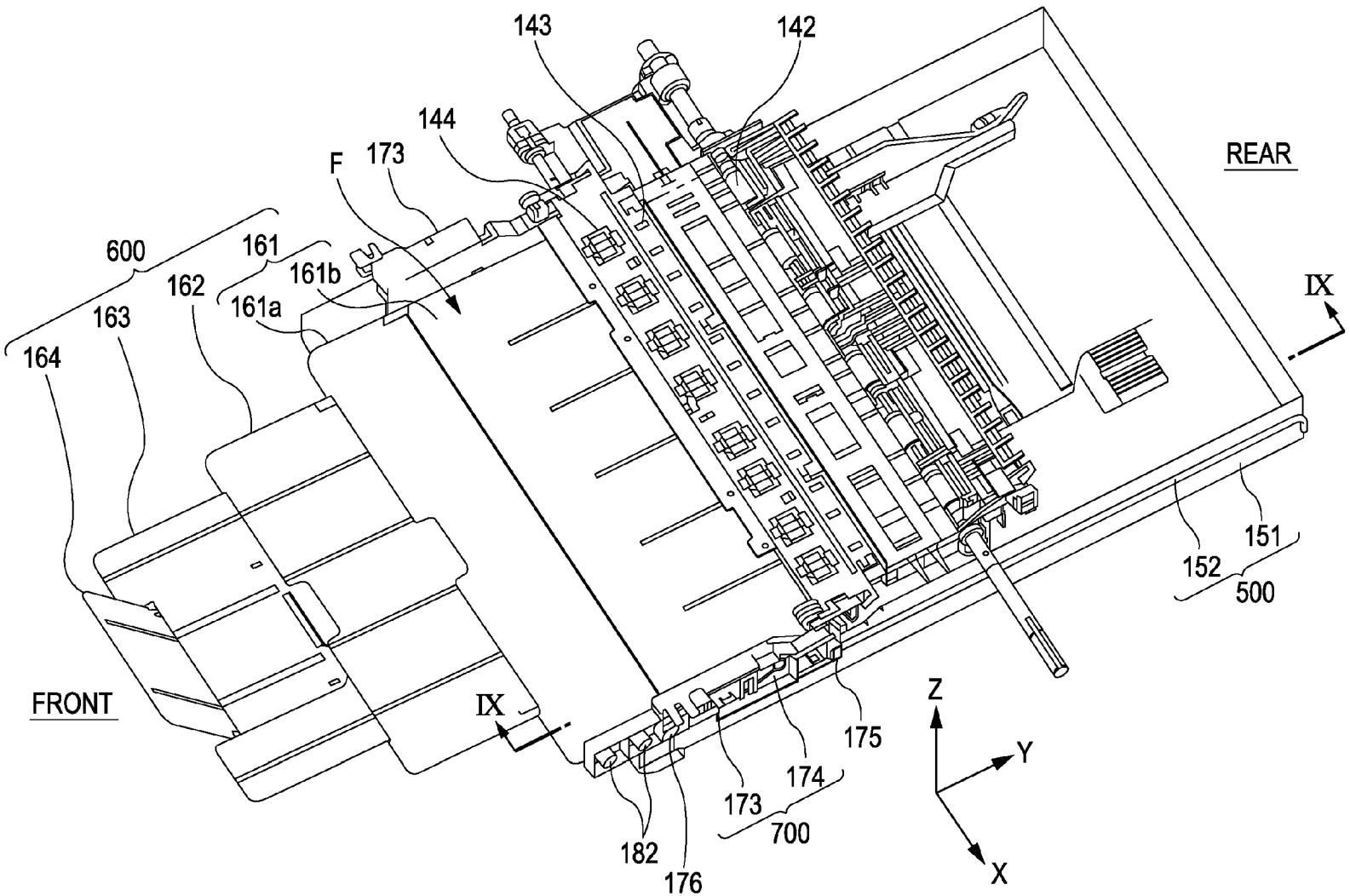
FIG. 7 is a perspective view of a recording media cassette, a discharge holding section and a moving unit according to a sixth embodiment of the invention.

Here, as shown in FIG. 6, when the recording media cassette 5 is inserted into the case 2, before the cam 52 contacts with the cam follower 70, the upper portion of the recording media cassette 5 collides with the lower portion of the discharge holding section 6 in a descent state. Thus, the front side of the discharge holding section 6 is picked up. At this time, if the configuration is such that each second boss section 66 is movable only in the up and down direction in each second engaging hole 76, "a end" is generated between each second engaging hole 76 and each second boss section 66, and the discharge holding section 6 cannot be normally rose.

Accordingly, each second engaging hole 76 of the embodiment is formed such that the width of the upper portion thereof is widened in the front and rear direction (see, FIGS. 4A and 4B). Thus, when the discharge holding section 6 rotates about each first boss section 65 as the center, each second boss section 66 is allowed to be moved inside each second engaging hole 76. Thus, the front side of the discharge holding section 6 can be smoothly rotated (oscillated) and installation of the recording media cassette 5 to the case 2 can be appropriately performed.

In addition, the cam follower 70 contacts with the cam 52 so that the discharge holding section 6 is guided with a pair of left and right first engaging hole 75 and the second engaging holes 76, and moves upward. Each cam follower 70 according to the embodiment is arranged substantially at the center between the first boss section 65 and the second boss section 66, in other words, at just below of the spring engaging section 67 where the biasing force of the torsion spring 74 is received so that the discharge holding section 6 can be normally rose without generating "a end" between each of the boss sections 65 and 66 and each of the engaging holes 75 and 76.

In addition, as shown in FIGS. 4A and 4B, an engaging opening 79 through which the spring engaging section 67 inserts from inside thereof is penetrated and formed in each moving frame 73. Each fixing hook section 78 is installed near the upper portion of the engaging opening 79. Each fixing hook section 78 is formed in an upward hook-shape and the wire end of the other side of the torsion spring 74 is engaged. Each fixing boss section 77 is installed at the rear side of the fixing hook section 78 and is fixed so that the torsion spring 74 is wound. Each torsion spring 74 is formed such that the winding portion thereof is fixed to the fixing boss section 77 and the wire end of the other side thereof is fixed to the fixing hook section 78. Thus, each torsion spring 74 allows the wire end of one side to engage with the spring engaging section 67 and the discharge holding section 6 to bias the supply holding section 51 side (the lower side). In addition, in the embodiment, the torsion coil spring (the compression spring) is used as the biasing unit, however, a coil spring or a tension spring may be used. In other words, such a configuration may be good wherein the discharge holding section 6 is biased to the supply holding section 51 side (the lower side).

Next, the movement of the discharge holding section 6 by the moving unit 7 will be briefly described. Here, the maximum holding number of papers P is set in the supply holding section 51 and the recording media cassette 5 is arranged in the case 2 (see, FIG. 3A). In addition, the discharge holding section 6 does not hold the paper P and is in a moved state to the upper limit position.

The discharge holding section 6 is pressed downward by the bias force of each torsion spring 74 and each free roller 71 provided at the discharge main-body section 61 contacts with the top paper P laminated in the supply holding section 51. When the printing process is performed by the user instruction, the top paper P is transported by the transportation section 4. At this time, each free roller 71 rolls and contacts on the transported paper P.

When the upstream end of the paper P passes through each free roller 71, the discharge holding section 6 is descent as much as the thickness of the transported paper P by the biasing force of each torsion spring 74. Thus, each free roller 71 contacts with a paper P that is below the transported paper P. After that, the printing process can be continued until the discharge holding section 6 reaches the lower limit position (see, FIG. 3B).

According to the above described configuration, the discharge holding section 6 can enter into the supply holding section 51 so that height difference between the discharge holding section 6 and the paper discharging rollers 44 is widened as much as decreasing of the holding amount of the supply holding section 51. Thus, the holding capacity (the number of sheet that can be held) of the discharge holding section 6 is increased. In other words, since the holding capacity of the discharge holding section 6 can be varied in response to the amount (the holding amount) of the paper P that have been processed, a space according to the maximum capacity is not need to reserve beforehand on the discharge holding section 6. Accordingly, the supply holding section 51, the discharge holding section 6 and the moving unit 7 can be minimized without providing the wasted space and the recording apparatus 1 in which these members are installed can be downsized.

In the above described first embodiment, the recording media cassette 5, the discharge holding section 6 and the moving unit 7 are applied to a so-called horizontal type recording apparatus 1, however, may be applied to a so-called vertical type recording apparatus 1 wherein the recording media cassette 5 (the supply holding section 51) and the discharge holding section 6 are arranged in the standing posture. Even though illustration is omitted in the drawings, the recording apparatus 1 according to the second embodiment performs a desired recording while transporting the paper P (the recording media) in the standing posture, and holds (stacks) the recorded paper P that is discharged in the standing posture. In addition, since the recording apparatus 1 is similar to the first embodiment, except that the recording apparatus 1 is a so-called vertical type, detailed description is omitted.

According to the configuration, the discharge holding section 6 reliably moves with the torsion spring 74 along each first engaging hole 75 and each second engaging hole 76 in a direction where the holding capacity becomes large (the supply holding section 51 side) regardless whether it is the recumbent posture or the standing posture. In addition, since the paper P accommodated in the supply holding section 51 is pressed by each free roller 71, stable standing posture can be maintained. Accordingly, the paper P in the supply holding section 51 can be prevented from scattering and smooth transportation of the paper P toward the printing section 3 does not affected. Furthermore, since it is the vertical type, it is possible to miniaturize the recording apparatus 1.

The moving unit 7 according to a third embodiment will be described. In addition, the description and the illustration similar to the first embodiment and the second embodiment are omitted. The moving unit 7 according to the third embodiment is installed in the so-called vertical type recording apparatus 1, and has a holding amount detection unit that detects the holding amount of the paper P held in the supply holding section 51 or the discharge holding section 6, and a moving mechanism that moves the discharge holding section 6 along each of the engaging holes 75 and 76 based on a detection result of the holding amount detection unit.

The holding amount detection unit and the moving mechanism are connected to a control device (not shown). When the holding amount detection unit detects a holding amount that is set beforehand, the control device drives the moving mechanism and moves the discharge holding section 6 as much as the amount (the distance) that is set beforehand. As described above, the holding amount of the paper P in the supply holding section 51 or the discharge holding section 6 is detected by the holding amount detection unit and then the discharge holding section 6 can be moved so that the holding amount of the discharge holding section 6 is appropriately retained. In addition, as the holding amount detection unit, a photo sensor and a distance sensor (using the ultrasonic waves, the infrared light or the laser light) may be used. In addition, as the holding amount detection unit, a counter counting the number of the discharged paper P or the supplied paper P may be used. In addition, as the moving mechanism, a pinion gear and rack gear driven by a motor, a ball screw mechanism, a piston•cylinder mechanism (a hydraulic, a pneumatic, or the like) or the like may be used.

The moving unit 7 according to a fourth embodiment will be described. In addition, the description and the illustration similar to the first embodiment are omitted. The moving unit 7 according to the fourth embodiment is used in the so-called horizontal type recording apparatus 1 similar to that according to the first embodiment. The moving unit 7 omits the torsion spring 74 and is configured of the discharge holding section 6 its own moving downward by own weight along each of the engaging holes 75 and 76.

According to the configuration, when the paper P laminated in the supply holding section 51 is supplied to the printing section 3, the discharge holding section 6 descends with the own weight according to the reduced laminated amount in the supply holding section 51. Thus, a mechanism moving the discharge holding section 6 can be omitted and the configuration of the moving unit 7 can be simplified. Accordingly, it is possible to save the space and lower the cost of the moving unit 7 and the recording apparatus 1.

The discharge holding section 6 according to each of above described embodiments is arranged with overlapped (or adjacent to) on the upper portion of the supply holding section 51. Thus, the paper P that is laminated in the supply holding section 51 is subjected to the printing process and the discharge holding section 6 (the discharge main-body section 61) is entered in the reduced space that is generated so that the holding capacity of the paper P in the discharge holding section 6 is increased. In other words, the invention uses an inverse relationship between the decrease of the paper P in the supply holding section 51 and the increase of the paper P in the discharge holding section 6.

However, in the recording apparatus 1 according to a fifth embodiment, the discharge holding section 6 is arranged at a position (not shown) away from the supply holding section 51. In other words, the discharge holding section 6 is configured such that the holding capacity is allowed to be increased in response to the increase of the holding amount of the paper P in the discharge holding section 6, regardless the decrease of the paper P laminated in the supply holding section 51.

When the configuration is applied to the horizontal type recording apparatus 1, the moving unit 7 provides a spring instead of the torsion spring 74, which always biases the discharge holding section 6 (the discharge main-body section 61) to upward. In addition, type of spring is arbitrary and it may be the compression spring or may be the tension spring. When the paper P is discharged on the discharge holding section 6, the spring is stretched or contracted with the weight of the paper P, and the discharge holding section 6 moves to downward. In other words, the discharge holding section 6 moves to downward as the discharged paper P is increased. Meanwhile, when the configuration is applied to the vertical type recording apparatus 1, the moving unit 7 may use the moving unit 7 according to the third embodiment.

As shown in FIGS. 7 to 9B, the recording apparatus 100 includes an ink jet type printing section 300 that performs a printing process on a paper P facing a transport path, a transportation section 400 that transports the paper P sheet along the transport path, a recording media cassette 500 that accommodates the paper P in the recumbent posture and is detachably installed to a case 200, a discharge holding section 600 that holds (stacks) the discharged paper P on which the printing (the recording) is performed, a rotation unit 700 that rotates the discharge holding section 600 so as to enter into the recording media cassette 500, and an apparatus frame (not shown) that supports the transportation section 400, the printing section 300, or the like. A media holding device is configured including the recording media cassette 500, the discharge holding section 600 and the rotation unit 700.

Figure 8:
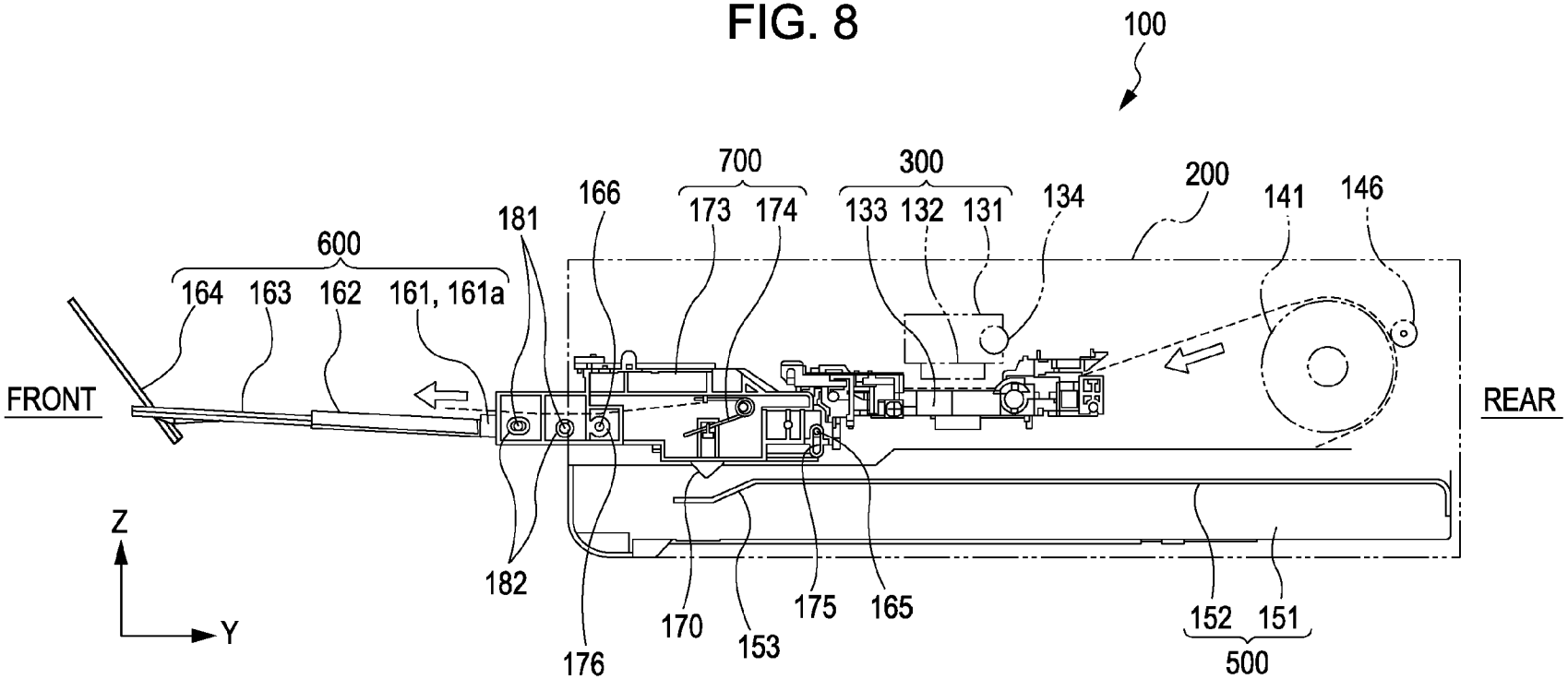
FIG. 8 is a side view of a recording media cassette, a discharge holding section and a moving unit according to a sixth embodiment of the invention.

As shown in FIG. 8, the printing section 300 has a carriage 131 that is arranged at a downstream side of a pair of transportation rollers 142 (described below) and equipped with an ink jet head 132, and a guide member 133 provided at a position opposite to the ink jet head 132.

The carriage 131 is provided movably reciprocated by a motor (not shown) along the carriage guide shaft 134 extending in the X-axis direction. The recording apparatus 100 of the embodiment uses a so-called off-carriage type serial printer, in which the ink cartridge (not shown) is provided independently of the carriage 131, and the carriage 131 performs the recording while moving in the X-axis direction. In addition, the guide member 133 configures of a portion of the transport path and defines a gap (a work gap) between a recording surface of the paper P and the ink jet head 132.

In addition, the embodiment uses the off-carriage type serial printer, however, it may a so-called on-carriage type that is equipped in the ink carriage 131, or may use a fixed type ink jet head 132 that covers a width of the paper P. Furthermore, it is not limited to the ink jet type and may be other recording types.

Figure 9A:
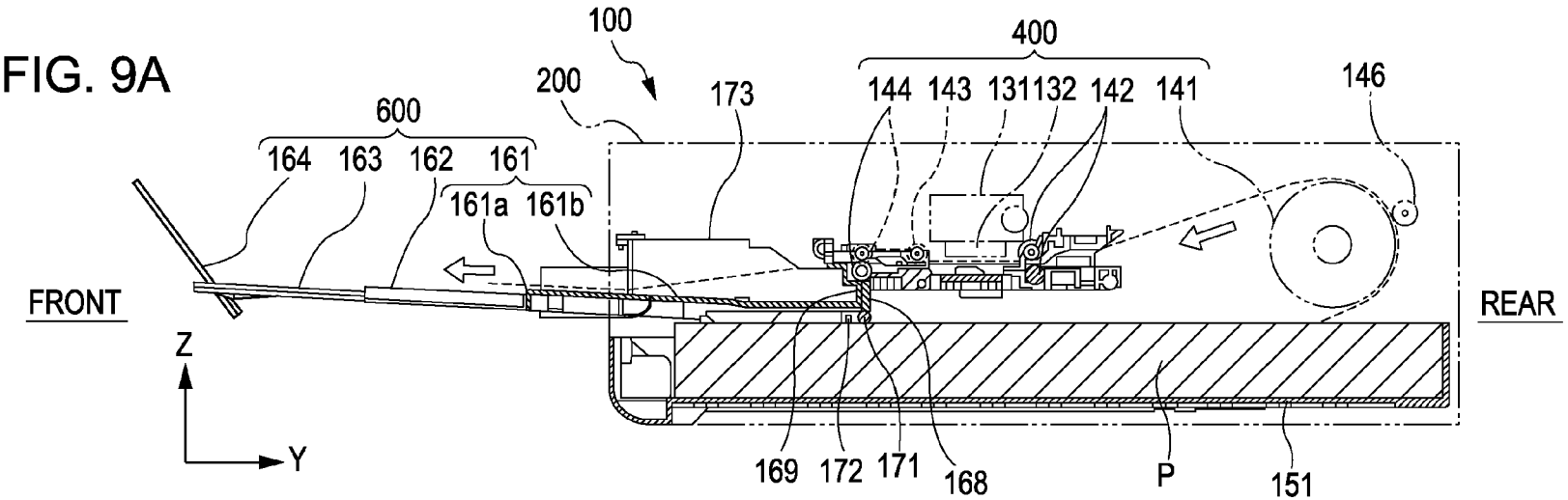
FIG. 9A is a cross-sectional view of a recording media cassette and a discharge holding section taken along line IXA-IXA of FIG. 7.
Figure 9B:
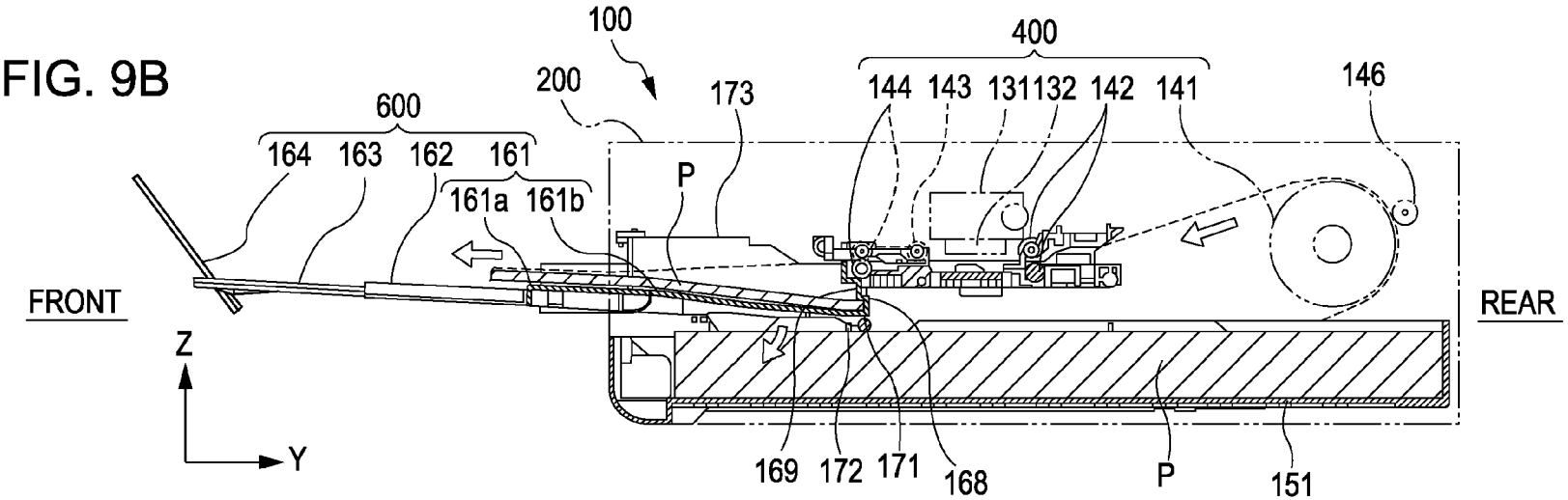
FIG. 9B is a cross-sectional view of a recording media cassette and a discharge holding section taken along line IXB-IXB of FIG. 7.

As shown in FIGS. 9A and 9B, the transportation section 400 has a feeding roller 141 that is provided at a position opposite to a end of the recording media cassette 500 installed from an upstream side and transports the paper P to a downstream side, which is supplied from the recording media cassette 500, a pair of transportation rollers 142 that transports the paper P to the printing section 300, a guide roller 143 that prevents the paper P from lifting at the guide member 133 of the printing section 300, and paper discharging rollers 144 as a pair of discharging rollers that discharges the recorded paper P from the printing section 300.

The top paper P of laminated and accommodated papers in the recording media cassette 500 is picked up by a pick-up roller (not shown). Thus, the feeding roller 141 is rotated by a motor (not shown) in a state where the feeding roller 141 contacts the end of the picked up paper P so that the paper P is transported in a rear direction in FIGS. 9A and 9B. In a position opposite to an outer peripheral surface of the feeding roller 141, a guide member (not shown) that forms a substantially U-shaped transport path where the paper P is curved and inverted, and an auxiliary driven roller 146 that helps transportation of the paper P with the feeding roller 141 are installed.

The paper P transported in the rear direction is positively inverted by the feeding roller 141 and the guide member, and is transported to the transportation roller 142 (see broken lines in FIGS. 8 to 9B). The paper P is pinched between a pair of transportation rollers 142 and transported to the printing section 300. The paper P where the recording is performed at the printing section 300 is discharged to the discharge holding section 600 via guide roller 143 and a pair of paper discharging rollers 144.

In addition, in the embodiment, the feeding roller 141 (and the auxiliary driven roller 146), the transportation roller 142 and the paper discharging roller 144 take a nip-roller shape respectively and arranged in plurality with appropriate intervals in the width direction (the X-axis direction) of the paper P. In the embodiment, the transportation roller 142 and the paper discharging roller 144 positioned at the guide member 133 side are driven to rotate by the motor (not shown) respectively, and the transportation roller 142, the guide roller 143 and the paper discharging roller 144 positioned at the ink jet head side are to be driven respectively. In addition, the paper discharging roller 144 of the driving side is configured of a rubber roller, and the guide roller 143 and the paper discharging roller 144 are configured of spur-shaped rollers (star wheels).

As shown in FIGS. 8 to 9B, the recording media cassette 500 is installed inside the case 200 with the recumbent posture and is slid to the case 200 in the horizontal direction so that the recording media cassette 500 is allowed to be attached/detached (inserted/removed). The recording media cassette 500 has a supply holding section 151 that overlaps and holds the paper P supplying to the printing section 300, and a pair of left and right cams 152 that abuts a cam follower 170 (described below) of the discharge holding section 600.

The supply holding section 151 is formed in a tray-shape as the upper surface is opened and the paper P are set in a state where a plurality of papers P is laminated. Each cam 152 is projected to the outside throughout from the rear end to near the front end in the both-side surfaces of the supply holding section 151. Each cam 152 abuts each cam follower 170 provided at the discharge holding section 600, and becomes a guide when the recording media cassette 500 is inserted/removed from the case 200. In addition, each cam follower 170 abuts each cam 152, and then the discharge holding section 600 is pushed up so that each free roller 171 (described below) provided attachment rear surface is not contacted with the top paper P set in the supply holding section 151. Accordingly, it is possible to prevent contamination due to contact between the paper P and each free roller 171 when the recording media cassette 500 is inserted or removed from the case 200.

In addition, an inclined section 153 is formed downward at a front portion of the cam 152 so that the cam follower 170 does not make contact with the inclined section 153 when the recording media cassette 500 is set to the case 200 (see, FIG. 8). In other words, a step is provided at the cam 152. In addition, the inclined section 153 is provided at a position where the cam follower 170 does not make contact with the inclined section 153 in a state where the discharge holding section 600 moves to the lower limit position.

As shown in FIGS. 8 to 9B, the discharge holding section 600 is installed on the recording media cassette 500 in the recumbent posture, and overlaps and holds the paper P discharged from the printing section 300. The discharge holding section 600 has a discharge main-body section 161 that freely goes up and down, and engages with the rotation unit 700, a second discharging section 162 that is freely slid in the front and rear (the Y-axis) direction and is provided to the discharge main-body section 161, a third discharging section 163 that freely slides in the front and rear direction and is provided to the second discharging section 162, and a fourth discharging section 164 that freely rotates and is provided to the downstream end of the third discharging section 163. In addition, the second discharging section 162 and the third discharging section 163 are appropriately drawn out according to the size of the paper P so that a holding surface that holds the discharged paper P is formed. In addition, the fourth discharging section 164 is also appropriately to be rotated so that the holding surface of the paper P is formed.

As shown in FIGS. 9A to 11B, the discharge main-body section 161 has a fixing holding section 161*a* that holds the front (the downstream side in the discharging direction) of the paper P and a movable holding section 161*b* that holds the rear side (the upstream side in the discharging direction) of the paper P rotatably supported to the fixing holding section 161*a*. The upper surface of the fixing holding section 161*a* and the movable holding section 161*b* becomes a main-body holding surface F that holds the discharged paper P.

The fixing holding section 161*a* has a pair of two set of support boss sections 181 that are projected to the left and right both-side surfaces in the front and the rear end thereof. The fixing holding section 161*a* immovably supports to the rotation frame 173 (described later) of the rotation unit 700 via four support boss sections 181.

The movable holding section 161*b* has a pair of first boss sections 165 that is projected to the left and right both-side surfaces in the rear end, a pair of second boss sections 166 that is projected to the left and right both-side surfaces in the front end thereof, a pair of spring engaging sections 167 that is substantially provided at the center between the first boss section 165 and the second boss section 166 in the front and rear direction, and a support piece 168 that supports the upstream end of the held paper P. In addition, the discharge main-body section 161 has a cam follower 170 that is projected to downward from the left and right both-side surfaces in downward of each spring engaging section 167, and a pair of left and right free rollers 171 that is installed just below of the support piece 168 in the back surface thereof.

The movable holding section 161*b* is installed with overlapped, which can enter from the upward to the front of the supply holding section 151 in a state where the recording media cassette 500 is set to the case 200. The movable holding section 161*b* rotatably supports the rear side (the first boss section 165 side) thereof with the rotation unit 700 about a pair of left and right second boss sections 166 which is engaged with a second engaging hole 176 described below, as the rotation center. When the paper P (for example, a postcard or the like) is held, in which a waist of which is strong, a bending thereof is large after printing and the size thereof is small; the length of the movable holding section 161*b* in the Y-axis (the front and rear) direction and the projection position of each of the boss sections 165 and 166 are configured such that a center of gravity of the paper P thereof is fitted within the radius of the rotation of the movable holding section 161*b*.

Each spring engaging section 167 is formed in an upward hook-shape and a wire end of a torsion spring 174 (described below) is engaged. Each spring engaging section 167 penetrates in a rotation frame 173 (described below) and then exposed to the outside.

The support piece 168 is projected substantially perpendicularly from the main-body holding surface F to upward in the rear end of the movable holding section 161*b* (the main-body holding surface F). In addition, the support piece 168 is positioned at the rear side of the fixing supporting section 169 projected from the apparatus frame to the lower side, and overlaps (engages) to the fixing supporting section 169 in the Z-axis direction (see FIGS. 9A and 9B). In addition, the support piece 168 is formed so as to slightly overlap to the fixing supporting section 169 in a state where the movable holding section 161*b* is moved to the lower limit position (the maximum holding state) (see, FIG. 9B). Accordingly, in a state where the movable holding section 161*b* moves to the upper limit position, an overlap amount (a distance) is substantially the same as a rotation amount (an up and down distance) of the movable holding section 161*b*.

Each cam follower 170 is integrally formed to each side surface of the discharge main-body section 161 such that one vertex of the triangle is directed to the lower side. Thus, one vertex of the triangle abuts the above described cam 152.

Each free roller 171 is freely rotatably pivoted to a pair of roller arms 172 extending obliquely backward in the back surface of the rear end of the movable holding section 161*b*. Each free roller 171 enters into the supply holding section 151 from the upper side and makes contacts with the top paper P of the bundle of papers that are set at the supply holding section 151 (see, FIGS. 9A and 9B).

The free roller 171 is a contact member that can make contact with the paper P held in the supply holding section 151. When the top paper P is driven by the transportation section 400, each free roller 171 is driven to rotate according to the transportation of the paper P. Accordingly, the supply and the transportation of the paper P can be smoothly performed without damaging the top (the outermost sheet) paper P.

Figure 10A:
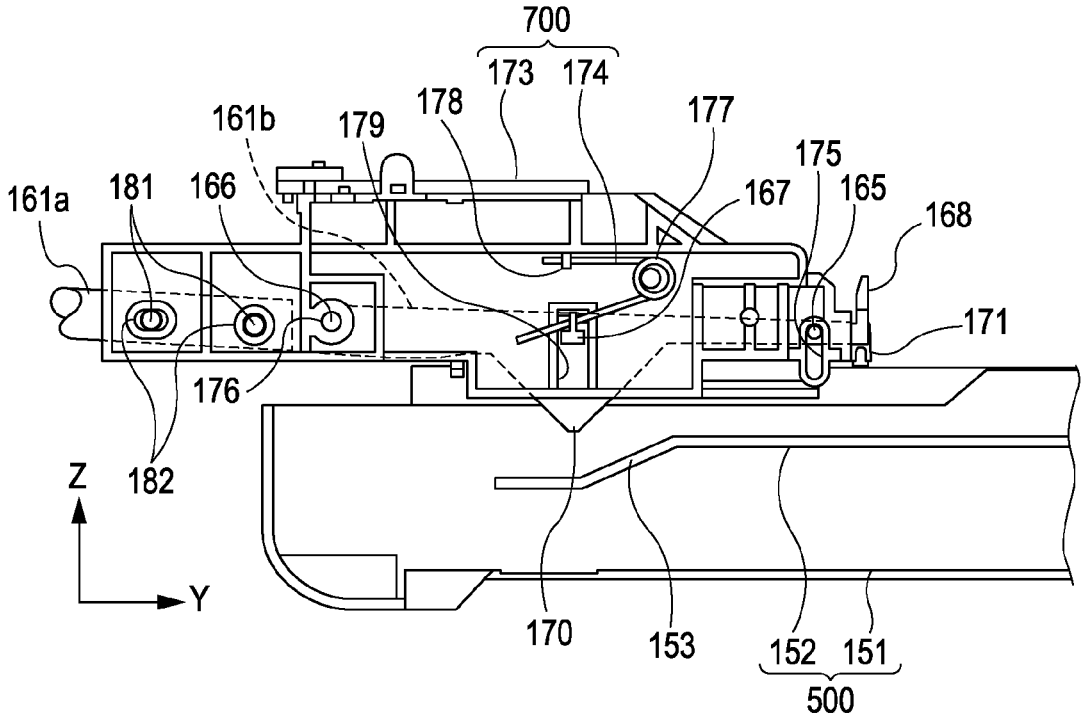
FIGS. 10A and 10B are partially enlarged side views illustrating a recording media cassette, a discharge holding section and a moving unit according to a sixth embodiment of the invention.
Figure 10B:
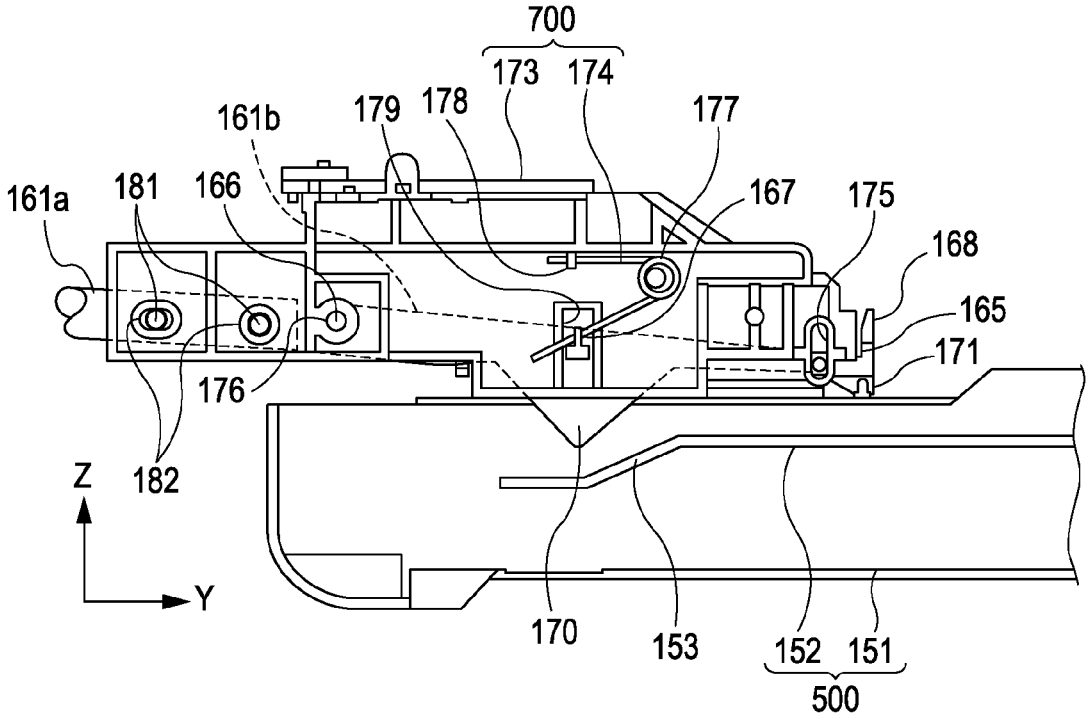
Figure 11A:
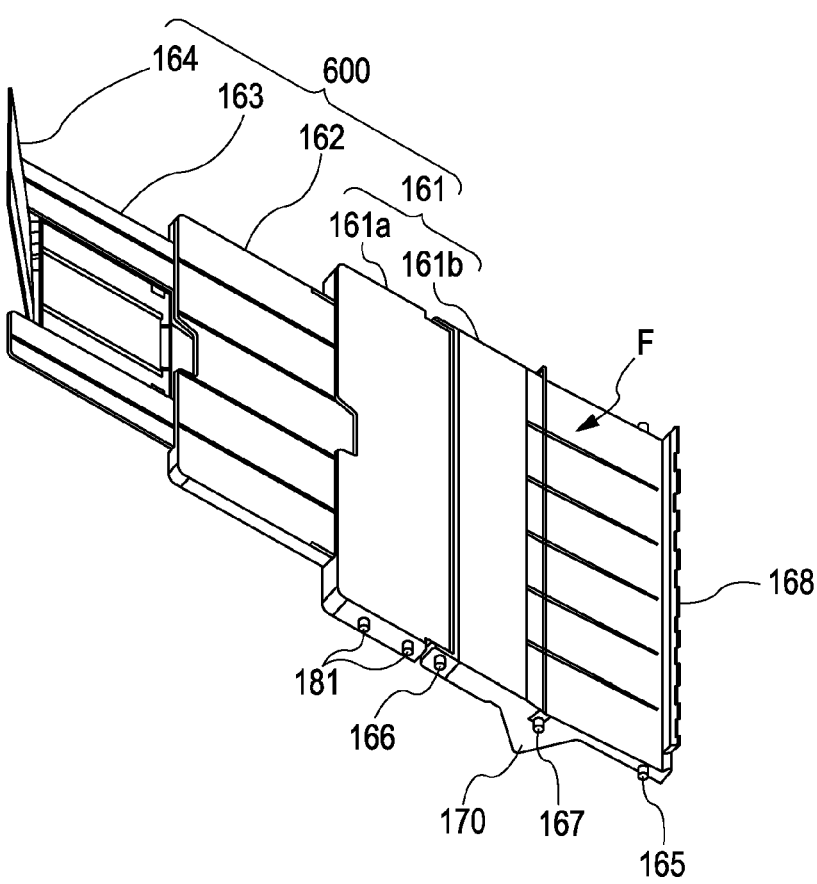
FIG. 11A is a front perspective view of a discharge holding section according to a sixth embodiment of the invention.
Figure 11B:
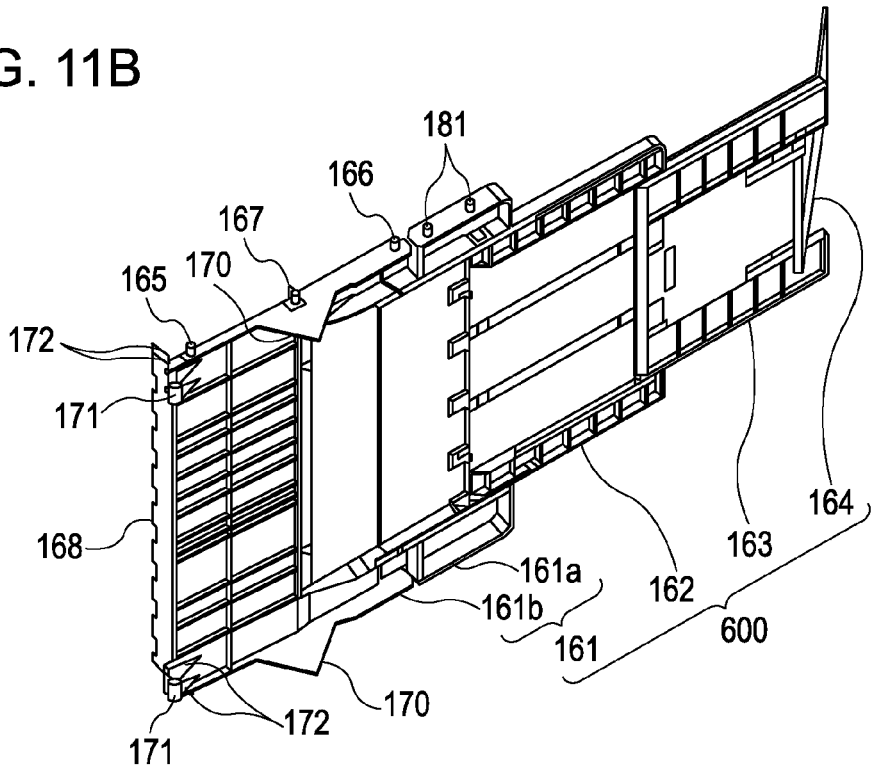
FIG. 11B is a rear perspective view of a discharge holding section according to a sixth embodiment of the invention.

As shown in FIGS. 8, 10A and 10B, the rotation unit 700 has a pair of left and right moving frames 173 that is supported to the apparatus frame in the downstream side of the paper discharging rollers 144, and a pair of left and right torsion springs 174 that biases the discharge holding section 600 to the supply holding section 151.

Each rotation frame 173 has two support engaging holes 182 in which two front and rear support boss sections 181 of the fixing holding section 161*a* are engaged, a first engaging hole 175 where the first boss section 165 engages, a second engaging hole 176 where the second boss section 166 is engages, a fixing boss section 177 where the torsion spring 174 is fitted and fixed, and a fixing hook section 178 where a wire end of the other side of the torsion spring 174 is engaged and fixed.

The support engaging holes 182 penetrates and formed in the X-axis direction at a position corresponding to two support boss sections 181 in the front portion of each rotation frame 173. Specifically, the support engaging hole 182 in which the support boss section 181 projected to the front end of the fixing holding section 161*a* is a long hole formed long in the Y-axis (the front and rear) direction, while the support engaging hole 182 of the rear side thereof is around hole. Each support boss section 181 engages (fits) with a pair of two set support engaging holes 182 so that the fixing holding section 161*a* is immovably supported to each rotation frame 173.

Next, each first engaging hole 175 is a long hole that penetrates in the X-axis direction in the rear end of the rotation frame 173 and then is formed long in the Z-axis (the up and down) direction. Each second engaging hole 176 is a round hole that is penetrated and formed in the X-axis direction in near the center of the rotation frame 173. Each first boss section 165 movably (rotatably) engages with each first engaging hole 175 in the up and down direction, and each second boss section 166 movably engages (fits) with each second engaging hole 176. Accordingly, the movable holding section 161*b* rotates (moves up and down) as the a pair of left and right first boss sections 165 as the shaft sections is guided by a pair of left and right first engaging holes 175 as guide sections about a pair of left and right second boss sections 166 as the center thereof. In addition, since each first boss section 165 draws a track of an arc, each first engaging hole 175 is formed as slightly inclined so as not to obstruct the rotation thereof.

In addition, a length of each first engaging hole 175 is a rotation distance of the movable holding section 161*b*, and is substantially the same as an overlap amount (a distance) in a state where the rear end of the movable holding section 161*b* moves to the upper limit position. Accordingly, the upper limit position of the movable holding section 161*b* is a position where each first boss section 165 rotates (moves) to the upper end of each engaging holes 175 (see FIGS. 9A and 10A), while the lower limit position of the rear end of the movable holding section 161*b* is a position where each first boss section 165 rotates (moves) to the lower end of each first engaging hole 175 (see FIGS. 9B and 10B).

In addition, as shown in FIGS. 10A and 10B, an engaging opening 179 through which the spring engaging section 167 inserts from inside thereof is penetrated and formed in each rotation frame 173. Each fixing hook section 178 is installed near the upper portion of the engaging opening 179. Each fixing hook section 178 is formed in an upward hook-shape and the wire end of the other side of the torsion spring 174 is engaged. Each fixing boss section 177 is installed at the rear side of the fixing hook section 178 and is fixed so that the torsion spring 174 is wound. Each torsion spring 174 is formed such that the winding portion thereof is fixed to the fixing boss section 177 and the wire end of the other side thereof is fixed to the fixing hook section 178. Thus, each torsion spring 174 allows the wire end of one side to engage with the spring engaging section 167 and the movable holding section 161*b* to bias the supply holding section 151 side (the lower side). In addition, in the embodiment, the torsion coil spring (the compression spring) is used as the biasing unit, however, a coil spring or a tension spring may be used. In other words, such a configuration may be good wherein the discharge holding section 600 is biased to the supply holding section 151 side (the lower side).

Next, the rotation of the movable holding section 161*b* by the rotation unit 700 will be briefly described. Here, the maximum holding number of papers P is set in the supply holding section 151 and the recording media cassette 500 is arranged in the case 200 (see, FIG. 9A). In addition, the discharge holding section 600 does not hold the paper P and the movable holding section 161*b* is in a moved state to the upper limit position.

The movable holding section 161*b* is pressed downward by the bias force of each torsion spring 174 and each free roller 171 makes contact with the top paper P laminated in the supply holding section 151. When the printing process is performed by the user instruction, the top paper P is transported by the transportation section 400. At this time, each free roller 171 rolls and makes contact with the transported paper P. When the upstream end of the paper P passes through each free roller 171, the movable holding section 161*b* is rotated as much as the thickness of the transported paper P by the biasing force of each torsion spring 174. Thus, each free roller 171 makes contact with a paper P that is below the transported paper P. After that, the printing process can be continued until the movable holding section 161*b* reaches the lower limit position (see, FIG. 9B).

According to the above described configuration, the movable holding section 161*b* can enter into the supply holding section 151 so that height difference between the discharge holding section 600 and the paper discharging rollers 144 is widened as much as decreasing of the holding amount of the supply holding section 151. Thus, the holding capacity (the number of sheet that can be held) of the discharge holding section 600 (the movable holding section 161*b*) is increased. In other words, since the holding capacity of the discharge holding section 600 (the movable holding section 161*b*) can be varied in response to the quantity (the holding amount) of the paper P that have been processed, a space according to the maximum capacity is not need to reserve beforehand on the discharge holding section 600. Accordingly, the supply holding section 151, the discharge holding section 600 and the rotation unit 700 can be minimized without providing the wasted space, and the recording apparatus 100 in which these members are installed can be downsized.

In the above described sixth embodiment, the recording media cassette 500, the discharge holding section 600 and the rotation unit 700 are applied to a so-called horizontal type recording apparatus 100, however, may be applied to a so-called vertical type recording apparatus 100 wherein the recording media cassette 500 (the supply holding section 151) and the discharge holding section 600 are arranged in the standing posture. Even though illustration is omitted in the drawings, the recording apparatus 100 according to the seventh embodiment performs a desired recording while transporting the paper P (the recording media) held in the standing posture, and holds (stacks) the recorded paper P that is discharged in the standing posture. In addition, since the recording apparatus 100 is similar to the sixth embodiment, except that the recording apparatus 100 is a so-called vertical type, detailed description is omitted.

According to the configuration, the movable holding section 161*b* reliably rotates with each torsion spring 174 along each first engaging hole 175 about each second engaging section 176 as the rotation center thereof in a direction where the holding capacity becomes large (the supply holding section 151 side) regardless whether it is the recumbent posture or the standing posture. In addition, since the paper P accommodated in the supply holding section 151 is pressed by each free roller 171, stable standing posture can be maintained. Accordingly, the paper P in the supply holding section 151 can be prevented from scattering and smooth transportation of the paper P toward the printing section 300 does not affected. Furthermore, since it is the vertical type, it is possible to miniaturize the recording apparatus 100.

The rotation unit 700 according to a eighth embodiment will be described. In addition, the description and the illustration similar to the sixth embodiment and the seventh embodiment are omitted. The rotation unit 700 according to the eighth embodiment is installed in the so-called vertical type recording apparatus 100, and has a holding amount detection unit that detects the holding amount of the paper P held in the supply holding section 151 or the discharge holding section 600, and a rotation mechanism that rotates the movable holding section 161*b* along each first engaging holes 175, based on a detection result of the holding amount detection unit.

The holding amount detection unit and the rotation mechanism are connected to a control device (not shown). When the holding amount detection unit detects a holding amount that is set beforehand, the control device drives the rotation mechanism and rotates the movable holding section 161*b* as much as the amount (the distance) that is set beforehand. As described above, the holding amount of the paper P in the supply holding section 151 or the discharge holding section 600 is detected by the holding amount detection unit and then the movable holding section 161*b* can be rotated so that the holding amount of the discharge holding section 600 (the movable holding section 161*b*) is appropriately retained. In addition, as the holding amount detection unit, a photo sensor and a distance sensor (using the ultrasonic waves, the infrared light or the laser light) may be used. In addition, as the holding amount detection unit, a counter counting the number of the discharged paper P or the supplied paper P may be used. In addition, as the rotation mechanism, a pinion gear and rack gear driven by a motor, a ball screw mechanism, a piston•cylinder mechanism (a hydraulic, a pneumatic, or the like) or the like may be used.

The rotation unit 700 according to a ninth embodiment will be described. In addition, the description and the illustration similar to the first embodiment are omitted. The rotation unit 700 according to the ninth embodiment is used in the so-called horizontal type recording apparatus 100 similar to that according to the sixth embodiment. The rotation unit 700 omits the torsion spring 174 and is configured of the movable holding section 161*b* its own moving downward by own weight along each first engaging hole 175.

According to the configuration, when the paper P laminated in the supply holding section 151 is supplied to the printing section 300, the movable holding section 161*b* rotates and descends with the own weight in response to the reduced laminated amount in the supply holding section 151. Thus, a mechanism rotating the movable holding section 161*b* can be omitted and the configuration of the rotation unit 700 can be simplified. Accordingly, it is possible to save the space and lower the cost of the rotation unit 700 and the recording apparatus 100.

The discharge holding section 600 according to each of above described embodiments is arranged with overlapped (or adjacent to) on the upper portion of the supply holding section 151. Thus, the paper P that is laminated in the supply holding section 151 is subjected to the printing process and the discharge holding section 600 (the movable holding section 161*b*) is entered in the reduced space that is generated so that the holding capacity of the paper P in the discharge holding section 600 (the movable holding section 161*b*) is increased. In other words, the invention uses an inverse relationship between the decrease of the paper P in the supply holding section 151 and the increase of the paper P in the discharge holding section 600.

However, in the recording apparatus 100 according to a tenth embodiment, the discharge holding section 600 is arranged at a position (not shown) away from the supply holding section 151. In other words, the discharge holding section 600 is configured such that the holding capacity is allowed to be increased in response to the increase of the holding amount of the paper P in the discharge holding section 600, regardless the decrease of the paper P laminated in the supply holding section 151.

When the configuration is applied to the horizontal type recording apparatus 100, the rotation unit 700 provides a spring instead of the torsion spring 174, which always biases the movable holding section 161*b* to upward. In addition, type of spring is arbitrary and it may be the compression spring or may be the tension spring. When the paper P is discharged on the movable holding section 161*b*, the spring is stretched or contracted with the weight of the paper P, and the movable holding section 161*b* rotates to downward. In other words, the movable holding section 161*b* moves to downward as the discharged paper P is increased. Meanwhile, when the configuration is applied to the vertical type recording apparatus 100, the rotation unit 700 may use the rotation unit 700 according to the eighth embodiment.

The entire disclosures of Japanese Patent Application No.: 2011-045431, filed Mar. 2, 2011 and 2011-045432, filed Mar. 2, 2011 are expressly incorporated by reference herein.

What is claimed is:

1. A recording apparatus comprising:

a supply holding section that holds recording media which are supplied to a recording section, in an overlapping manner;

a discharging roller that discharges the recording media from the recording section;

a discharge holding section that holds recording media, which are discharged from the discharging roller, in an overlapping manner, and is installed movably to the supply holding section, in an overlapping manner; and a moving unit that is moved to move the discharge holding section to the supply holding section so as to widen a difference of a height between the discharge holding section and the discharging roller according to a decrease of a holding amount of the recording media in the supply holding section, which is in response to recording media being transported to a printing section for printing;

wherein the discharge holding section is supported by the recording media which is overlapping in the supply holding section.

2. The recording apparatus according to claim 1, wherein the discharge holding section has a contact member that can contact the recording media held in the supply holding section.

3. The recording apparatus according to claim 2, further including a shaft that is formed at a side surface of the discharge holding section, a guide that is formed at a frame opposite to the side surface of the discharge holding section and through which the shaft can move, and wherein the discharge holding section is configured so that the discharge holding section can move to the supply holding section while maintaining a posture thereof.

4. The recording apparatus according to claim 3, wherein the moving unit has a biasing unit that biases the discharge holding section to the supply holding section.

5. The recording apparatus according to claim 3, wherein the discharge holding section is installed in a recumbent posture and the moving unit is moved by its own weight.

6. The recording apparatus according to claim 2, wherein the discharge holding section has a fixing holding section that holds a downstream side of the recording media in the discharging direction and a movable holding section which is rotatably provided to the fixing holding section to hold an upstream side of the recording media in the discharging direction, wherein the movable holding section is movably arranged toward the supply holding section in an overlapping manner, wherein the moving unit includes a rotation unit that is rotated to move the movable holding section to the supply holding section so as to increase the height of the discharge holding section and the discharging roller in response to a decrease of the holding amount of the recording media in the supply holding section.

7. The recording apparatus according to claim 6, wherein the moving unit has a biasing unit that biases the discharge holding section to the supply holding section.

8. The recording apparatus according to claim 6, wherein the discharge holding section is installed in a recumbent posture and the moving unit is moved by its own weight.

9. The recording apparatus according to claim 6, wherein the contact member is a free roller.

10. The recording apparatus according to claim 2, wherein the contact member is a free roller.

11. A recording apparatus comprising:

a supply holding section that holds recording media which are supplied to a recording section, in an overlapping manner;

a discharging roller that discharges the recording media from the recording section;

a discharge holding section that holds recording media, which are discharged from the discharging roller, in an overlapping manner, and is installed movably to the supply holding section, in an overlapping manner; and a moving unit that is moved to move the discharge holding section to the supply holding section so as to widen a difference of a height between the discharge holding section and the discharging roller according to a decrease of a holding amount of the recording media in the supply holding section, which is in response to recording media being transported to a printing section for printing;

wherein the discharge holding section has a free roller that can contact the recording media held in the supply holding section, and wherein a cam is formed at one of the supply holding section and the discharge holding section, and a cam follower abutting the cam is formed at the other, and when setting the supply holding section in a state of being used, the cam abuts the cam follower and pushes up the free roller.

* * * * *